US009089879B2

(12) United States Patent
Brock

(10) Patent No.: US 9,089,879 B2
(45) Date of Patent: Jul. 28, 2015

(54) DEVICE AND METHOD FOR CLEANING WALL OR GROUND SURFACES

(71) Applicant: Rodinia Technologies Ltd., Nicosia (CY)

(72) Inventor: Albert Brock, Gehrden (DE)

(73) Assignee: RODINIA TECHNOLOGIES LTD., Nicosia (CY)

( * ) Notice: Subject to any disclaimer, the term of this patent is extended or adjusted under 35 U.S.C. 154(b) by 0 days.

(21) Appl. No.: 13/864,346

(22) Filed: Apr. 17, 2013

(65) Prior Publication Data

US 2013/0276838 A1 Oct. 24, 2013

(30) Foreign Application Priority Data

Apr. 18, 2012 (DE) ..... 10 2012 103 381

(51) Int. Cl.
*A47L 5/14* (2006.01)
*B08B 5/02* (2006.01)
*E01H 1/00* (2006.01)

(52) U.S. Cl.
CPC . *B08B 5/02* (2013.01); *E01H 1/005* (2013.01)

(58) Field of Classification Search
USPC ..... 15/340.1, 345, 346, 304, 397, 405, 406, 15/104.05, 312.1; 134/10, 21, 37, 104, 134/154
See application file for complete search history.

(56) References Cited

U.S. PATENT DOCUMENTS

| | | | | | |
|---|---|---|---|---|---|
| 3,959,010 | A * | 5/1976 | Thompson et al. | ..... | 134/21 |
| 4,168,562 | A * | 9/1979 | Maasberg | ..... | 15/320 |
| 4,670,936 | A * | 6/1987 | Hanson | ..... | 15/309.2 |
| 4,707,879 | A * | 11/1987 | Moszkowski | ..... | 15/345 |
| 4,938,239 | A * | 7/1990 | Theurer et al. | ..... | 134/21 |
| 5,276,940 | A * | 1/1994 | Renaudin | ..... | 15/345 |
| 7,017,226 | B2 * | 3/2006 | Ikeda et al. | ..... | 15/308 |

FOREIGN PATENT DOCUMENTS

| | | | |
|---|---|---|---|
| AT | 395991 | B | 6/2008 |
| DE | 1244221 | B | 7/1967 |
| DE | 8203164 | U1 | 7/1982 |
| DE | 19524203 | A1 | 6/1996 |
| DE | 102007010478 | A1 | 9/2008 |
| DE | 202009009649 | U1 | 7/2010 |
| DE | 102009029956 | A1 | 12/2010 |
| WO | WO 2010075828 | A1 | 7/2010 |

* cited by examiner

*Primary Examiner* — Dung Van Nguyen
(74) *Attorney, Agent, or Firm* — Leydig, Voit & Mayer, Ltd

(57) ABSTRACT

A device for cleaning wall surfaces, ground surfaces, track superstructures or tunnel walls is configured to be arranged on a rail vehicle that moves along a direction of travel. The device includes an aspirator opening and at least two air nozzles arranged in rows of air nozzles disposed on either side of the aspirator opening such that the aspirator opening is disposed between the rows of air nozzles. The rows of air nozzles are supplied with compressed air such that the pressure of the row of air nozzles disposed in front of the aspiration opening in the direction of travel of the rail vehicle is lower than the pressure of the other row of air nozzles.

13 Claims, 4 Drawing Sheets

DEVICE AND METHOD FOR CLEANING WALL OR GROUND SURFACES

CROSS REFERENCE TO RELATED APPLICATIONS

This application claims priority to German Patent Application No. DE 10 2012 103 381.1, filed Apr. 18, 2012, which is hereby incorporated by reference herein in its entirety.

FIELD

The invention relates to a device, to be arranged on a rail vehicle, for cleaning wall or ground surfaces, in particular inside tunnels or dividing surfaces, for example track superstructures or tunnel walls, the device comprising a plurality of air nozzles for compressed air arranged on either side of an aspiration opening. The invention further relates to a rail vehicle provided with such a device and to a method for operating the device.

BACKGROUND

Tunnels, walls and roofs are subject to continuous heavy soiling owing to the vehicles travelling through the tunnel, and therefore cleaning measures are required at regular intervals.

Devices of the type mentioned at the outset, which are used for surface cleaning on light railways as a key element in maintenance measures, are suitable for this purpose. As a result of the increasing soiling of railway facilities owing to waste, but also owing to brake sand, dust and metal particles abraded from the rails, measures must increasingly be taken to solve the problem of surface cleaning and thus improve not only the outward appearance of the railway facilities but also the resilience of the ballasted track by reducing soiling.

In these cleaning solutions, the dust-laden air is cleaned by means of either dry or wet filters. Solutions of this type often do not provide the desired effect when impurities caught between the ballast stones are not carried along with the suction flow.

WO 2010/075828 A1 also discloses a device for cleaning tunnel walls and tunnel roofs and for aspirating and cleaning ballast substructures, in which device a vortex which is immanent in the cleaning region and which provides the overpressure curtain required for operation is produced by inclining the air nozzles. In this case, the dirt particles which are loosened or released are drawn into the suction body specifically owing to the inclined position of the air nozzles.

DE 92 03 164 U1 further relates to a device for cleaning the rail track, which device can be fitted on a rail or multiway vehicle and comprises a lowerable suction box and at least one compressed-air nozzle in the suction box, the suction box and the compressed-air nozzle being connected to a suction unit and a compressor which are arranged on the vehicle.

DE 1 244 221 B discloses a device for cleaning points or rails, which device can be installed on a motor vehicle and comprises two nozzle boxes which are mounted on a trolley and can be moved thereby along the rails. A suction nozzle is arranged approximately centrally in each nozzle box and is connected to a boiler of the vehicle via a flexible hose. A suction box which extends laterally beyond the two rails has a plurality of compressed-air nozzles made of resilient material distributed over its entire width.

In practice, it has proven disadvantageous that the aspiration can result in turbulent mixing of the supplied compressed air with the air deflected from the surface and containing the dirt particles. In particular during cleaning of the track bed, during which the compressed-air jet impinges not on substantially planar surfaces but on a complex topography, the resulting swirls can impact on the cleaning power.

SUMMARY

In an embodiment, the present invention provides a device for cleaning wall surfaces, ground surfaces, track superstructures or tunnel walls is configured to be arranged on a rail vehicle that moves along a direction of travel. The device includes an aspirator opening and at least two air nozzles arranged in rows of air nozzles disposed on either side of the aspirator opening such that the aspirator opening is disposed between the rows of air nozzles. The rows of air nozzles are supplied with compressed air such that the pressure of the row of air nozzles disposed in front of the aspiration opening in the direction of travel of the rail vehicle is lower than the pressure of the other row of air nozzles.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
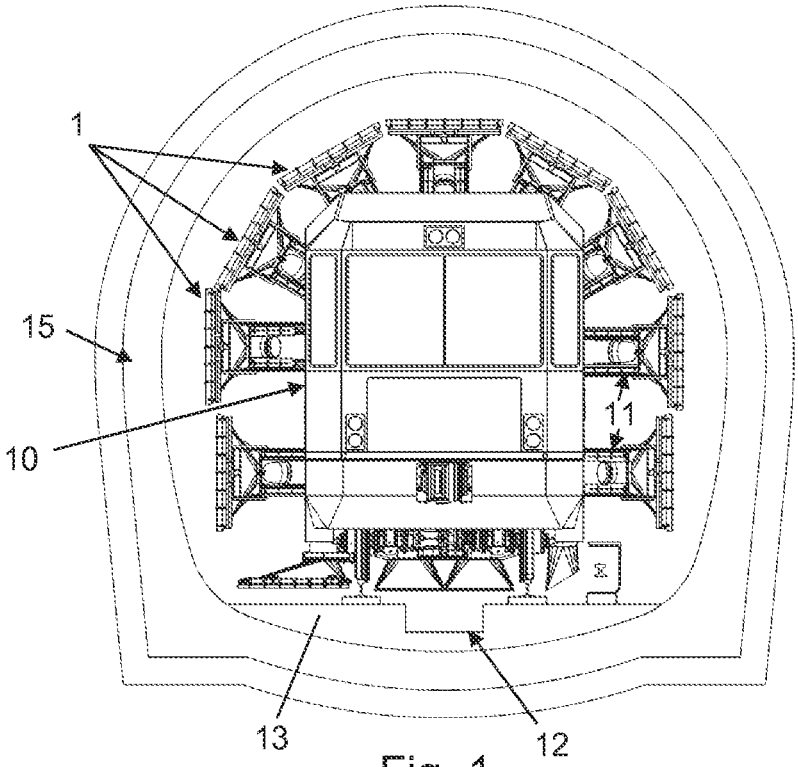
FIG. 1 shows a rail vehicle comprising a plurality of devices according to the invention in use inside a tunnel having a rounded cross-sectional shape.

The object of the invention is to provide an option for increasing the cleaning power at comparatively little cost. In particular, according to the invention an increase in efficiency is to be achieved.

According to the invention, a device is provided which comprises, adjacent to the aspiration opening, at least two air nozzles which are respectively arranged as a row of nozzles and between which the aspiration opening is located, and in which the rows of nozzles can be supplied with compressed air in such a way that the pressure of the row of nozzles arranged in front of the aspiration opening in the direction of travel of the vehicle is lower than the pressure of the other row of nozzles. The invention proceeds from the knowledge that at least one of the aspiration openings is surrounded in such a way by a first row of nozzles arranged in front of the aspiration opening in the direction of travel of the rail vehicle and a second row of nozzles arranged to the rear thereof that the aspiration region is defined and limited by the rows of nozzles. By adjusting the pressurisation such that the pressure of the row of nozzles which is in front in the direction of travel is lower than that of the rear row of nozzles, impurities of all types, for example objects, dust or other deposits, are collected between the rows of nozzles. If these impurities are not collected directly when the aspiration opening moves over them, they can be moved, that is to say carried along, in the direction of travel by the relatively strong, directed flow of the compressed air of the rear row of nozzles, the front row of nozzles simultaneously limiting the transportation of the impurities. As a result, the impurities are carried along quasi synchronously with the travel of the rail vehicle, in particular are thus not moved further than up to the first row of nozzles, and do not travel forwards beyond the front row of nozzles. The front row of nozzles thus acts as a compressed-air wall which does not displace the impurities when these are traveled over for the first time, and which acts as a limit for the impurities transported forwards by the rear row of nozzles. Limiting the ground surface region below the aspiration opening of the aspirator leads to a substantial increase in efficiency.

In addition, the device can comprise, adjacent to the aspiration opening, at least one air guide element which can be positioned with spacing from the wall or ground surface to be cleaned and via which the compressed air supplied by means of the rows of nozzles can, after impinging on the wall or ground surface, initially be deflected, substantially parallel to the surface, between said surface and the air guide element. The invention proceeds from the knowledge that the effectiveness and thus the efficiency of the device during operation can be increased substantially when at least a large proportion of the air flow produced travels not in a turbulent manner but rather in substantially laminar manner parallel to the wall or ground surface. According to the invention, a laminar air flow of this type is achieved in a simple manner by local separation of the air nozzles and the aspiration opening in conjunction with a flow zone in which the supplied air current is guided substantially parallel to the surface of the object to be cleaned by means of the air guide element. This results in a defined flow profile which is clearly divided into a zone, in particular a deflection zone of the supplied compressed air, parallel to the surface to be cleaned, and a further zone in the inlet region of the aspiration opening. The supplied and the aspirated air flows are thus separated without difficulty and an undesirable mixing zone is avoided. As a result, the cleaning power can be increased and the required power of the unit reduced. It has also been found that, owing to the uniform air flow, the flow rate required for removal of the dirt particles can be reduced. In addition, without changing the position of the device in relation to the surface, a substantially larger surface can be cleaned, since the cleaning effect is not limited to the region of the first impingement on the surface, but also includes the regions of the wall or ground surface over which the air between the air guide element and the surface flows.

In this context it is particularly promising if each row of nozzles can be subjected to a higher or lower pressure than the other row of nozzles depending on the direction of travel of the rail vehicle, as detected by means of a control unit, such that the aspiration function is obtained reliably in the two directions of travel.

It is also advantageous for the air nozzles to have an orientation which is inclined relative to the ground surface, in particular thus forms an acute angle with the ground surface, and for the air nozzles to be inclined such that at least the rear row of nozzles is directed to a ground surface region below the aspiration opening. Owing to this inclination, the air flow is directed to the ground surface in such a way that impurities can be transported in the direction of travel and carried along until aspiration.

In addition, acceleration of the air flow can be achieved via an inclined arrangement of the air guide elements in relation to the surface, thus in particular continuously closer to the ground surface, starting from an outer edge region of the air guide elements up to an aspiration opening, via a nozzle effect.

However, another configuration of the invention which likewise is particularly practice-oriented is also achieved when the air guide elements can be positioned parallel to the wall or ground surface to be cleaned, such that a constant flow rate of the compressed air over the entire region covered by each guide element is ensured.

In the case of another, likewise particularly expedient modification to the device according to the invention, in order to adjust the orientation, the air nozzles or the air guide elements are arranged such that they can be adjusted pivotally, in particular together, in particular are arranged such that they can be moved or pivoted, in order to be able to adapt rapidly to a different nature of the surface to be cleaned. For example, a corresponding adjusting movement can thus be initiated in the region of a widened track bed, as found for example in the region of stops, in order thereby to achieve continuous aspiration.

In addition, a modification in which the device can be positioned with different spacings from the surface is also of particular relevance to practice. The advantageous effect is that the flow rate between the aspirator and the surface can simultaneously be adapted as desired with the adjustment of the spacing. On the basis of the determined degree of soiling, the flow can thus be adapted to the required cleaning power simply by lowering or raising the device or the air guide elements.

The geometry and cross-sectional shape of the aspiration opening can be adapted to the respective conditions of use without difficulty. For example, it is possible to provide an aspiration opening having a circular inlet opening which is surrounded by a single concentric air guide element. In an advantageous variant of the invention, the aspiration opening is surrounded on at least two opposing sides by the rows of nozzles such that a substantially strip-shaped aspiration region is defined. By leaving at least one peripheral region of the aspiration opening free from the air nozzles, in conjunction with a movable arrangement of the device, even regions which are difficult to access, for example corners, can be reached by the aspiration region without the air nozzles proving a hindrance.

Further, the surface of the air guide element can be adjustable, that is to say able to be made larger or smaller, in order to be able to adapt to the respective conditions of use without changing the system technology.

The air nozzles could be arranged at an outer edge region of the air guide elements or connected to said region. However, it is particularly advantageous for a plurality of air nozzles to be arranged at a common intake, the air nozzles preferably being arranged side by side, for example along a straight line and with constant spacing from one another. Obviously, in this context the invention does not exclude different air nozzles of the same row of nozzles being subjected to a different pressure in order to control them individually.

In addition, it is a significant advantage when the intake can be positioned in an orientation parallel to the main extension of the surface, such that the spacing of the air nozzles from the surface is constant at least for a substantial part and the pressure distribution owing to the compressed air impinging on the surface is therefore uniform.

Effective aspiration power is also achieved when the rows of nozzles have an adjustable inclination angle and/or spacing with respect to the surface, so as thus to achieve a removal power which can be adapted optimally to the type of soiling by changing the flow angle in relation to the main extension of the surface. Obviously, the change can also take place while compressed air is being supplied, so as thus to apply changing pressure loads to adherent dirt particles.

In addition, it is also possible to vary the spacing of the air nozzles from the aspiration opening in the plane parallel to the surface, so as thus to be able to adapt the effective surface accordingly. However, a configuration in which the air nozzles have a spacing from the aspiration opening transverse to the aspiration direction of at least 50 mm, in particular at least 150 mm, is particularly suitable in practice. In this case, the air nozzles can be directly adjacent to the air guide element on the peripheral side, that is to say substantially without gaps, or have a suitable spacing therefrom. For example, the air guide element can have a spacing from the aspiration opening transverse to the aspiration direction of between 50 and 300 mm, preferably between 80 and 120 mm, the aspiration direction extending parallel to the surface normal of the surface to be cleaned.

In principle, the device is suitable for virtually any chassis. Preferably, the device forms, together with a dirt collection container and a drive unit, an autonomous movable unit which can be used in the region of urban underground railways without difficulty.

The device is obviously not limited to the cleaning of ground surfaces. Rather, owing to an arrangement which can be moved into a plurality of horizontal or vertical positions, the device is also equally suitable for wall or roof surfaces.

As a result, the entire tunnel cross-section can be treated accordingly in a single cleaning transit by means of a plurality of devices. If only sub-regions are to be cleaned, the devices allocated to the remaining regions can if necessary be allocated to the surfaces to be cleaned in order to improve the cleaning power further.

Figure 4:
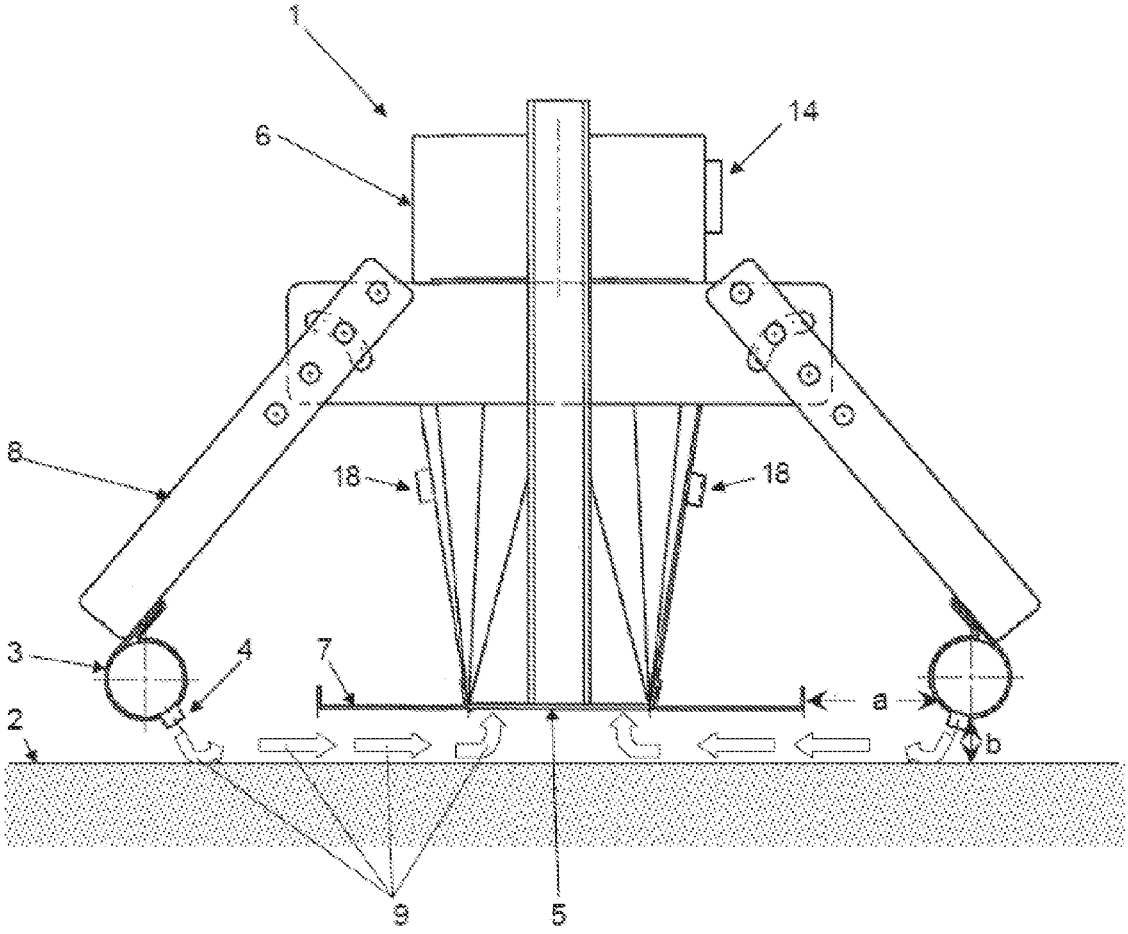
FIG. 4 is a side view of the device shown in FIG. 3.

When the device is used for cleaning wall or ground surfaces, in particular inside tunnels, or other lateral or upper limiting surfaces, for example track superstructures and tunnel walls, the device comprising a plurality of air nozzles for compressed air arranged on either side of an aspiration opening, and a plurality of aspiration openings covering at least approximately the entire opening cross-section of a tunnel or an underpass, in particular track bed, wall surface and roof surface, it has also proven particularly expedient for the device to comprise a control system and sensors, in order to detect in a timely manner the spacing in each case or obstacles which limit the free space. For this purpose, the device can be provided with corresponding distance measurement sensors, for example laser, ultrasonic, sonar or lidar, which detect a region in front of the aspiration opening in the direction of the movement of the device, and possible risks of collision can be detected in good time. FIG. 4 includes a schematic representation of an embodiment of a control system with a control unit 14 disposed on the device and corresponding sensors 18, which can be distance measurement sensors such as laser, ultrasonic, sonar, or lidar. The aspiration openings can then be moved without difficulty into a corresponding position, in particular a retracted passing position, in order to allow unhindered transit.

It is also advantageous for the aspiration power of the aspiration opening and/or the power of the compressed-air supply to the air nozzles to be adjustable in a variable manner, because the energy efficiency can be optimised further as a result. For this purpose, the aspiration power is reduced so much that the cleaning result is achieved reliably without providing an unnecessarily high aspiration power.

In addition, the aspiration power can be optimised further when an aspiration hood surrounding the aspiration opening, or the air guide element, is arranged such that it can be moved, in particular pivoted, to adjust a variable width of the surface covered by the aspiration hood. For this purpose, said hood can be pivotable about a substantially vertical axis which has spacing from the centre of the longitudinal axis, such that a pivoting movement increases the lateral extension of the aspiration opening. In some embodiments, the aspiration hood or the rows of nozzles can be movable by a drive by means of a non-positive force transmission element.

The device 1 according to the invention for cleaning a surface 2 formed by a wall or a track bed in the preferably underground region of urban railways or tramways will be described in detail below with reference to FIG. 1 to 5.

Figure 2:
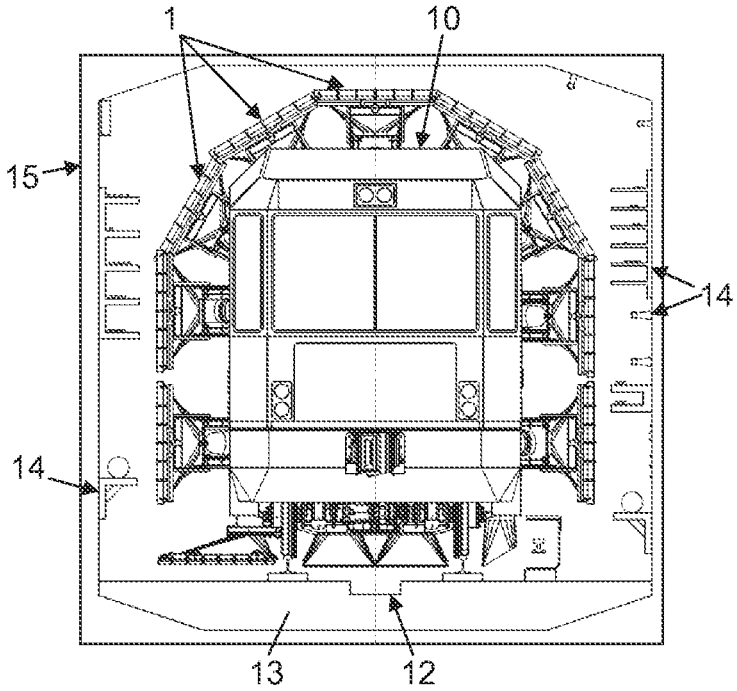
FIG. 2 shows the rail vehicle shown in FIG. 1 in a tunnel having a polygonal cross-sectional shape.

A plurality of the devices 1 are arranged on a rail vehicle 10 in such a way that they can, in conjunction with movement kinetics 11 (not shown in detail), be adapted without difficulty to virtually all conventional cross-sections, in particular in accordance with a rounded cross-sectional shape shown in FIG. 1 and a substantially rectangular cross-sectional shape shown in FIG. 2. In this context, the movement kinematics 11 also allows adaptation in channel-shaped cavities 12 in the track superstructure 13 or to line carriers 14 on the tunnel walls 15.

Figure 3:
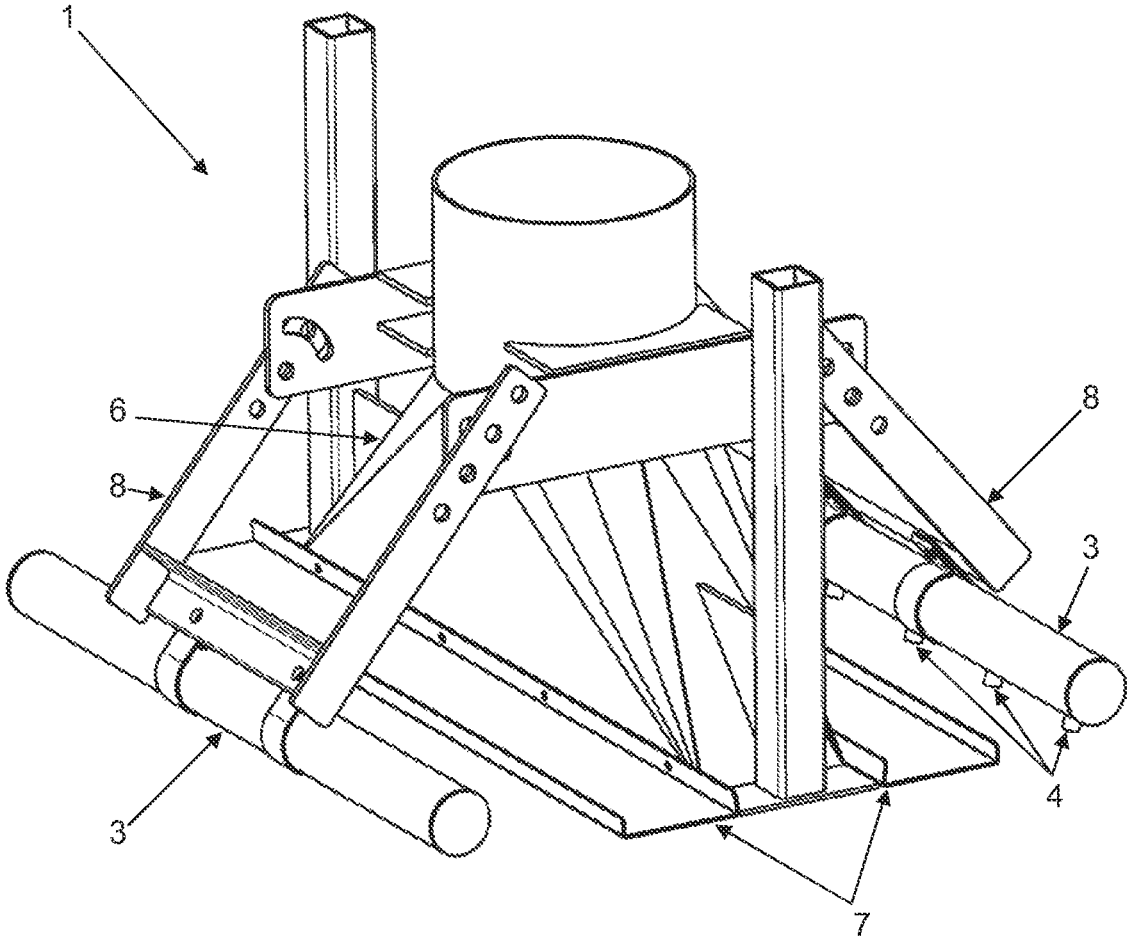
FIG. 3 is a perspective view of the device according to the invention.
Figure 5:
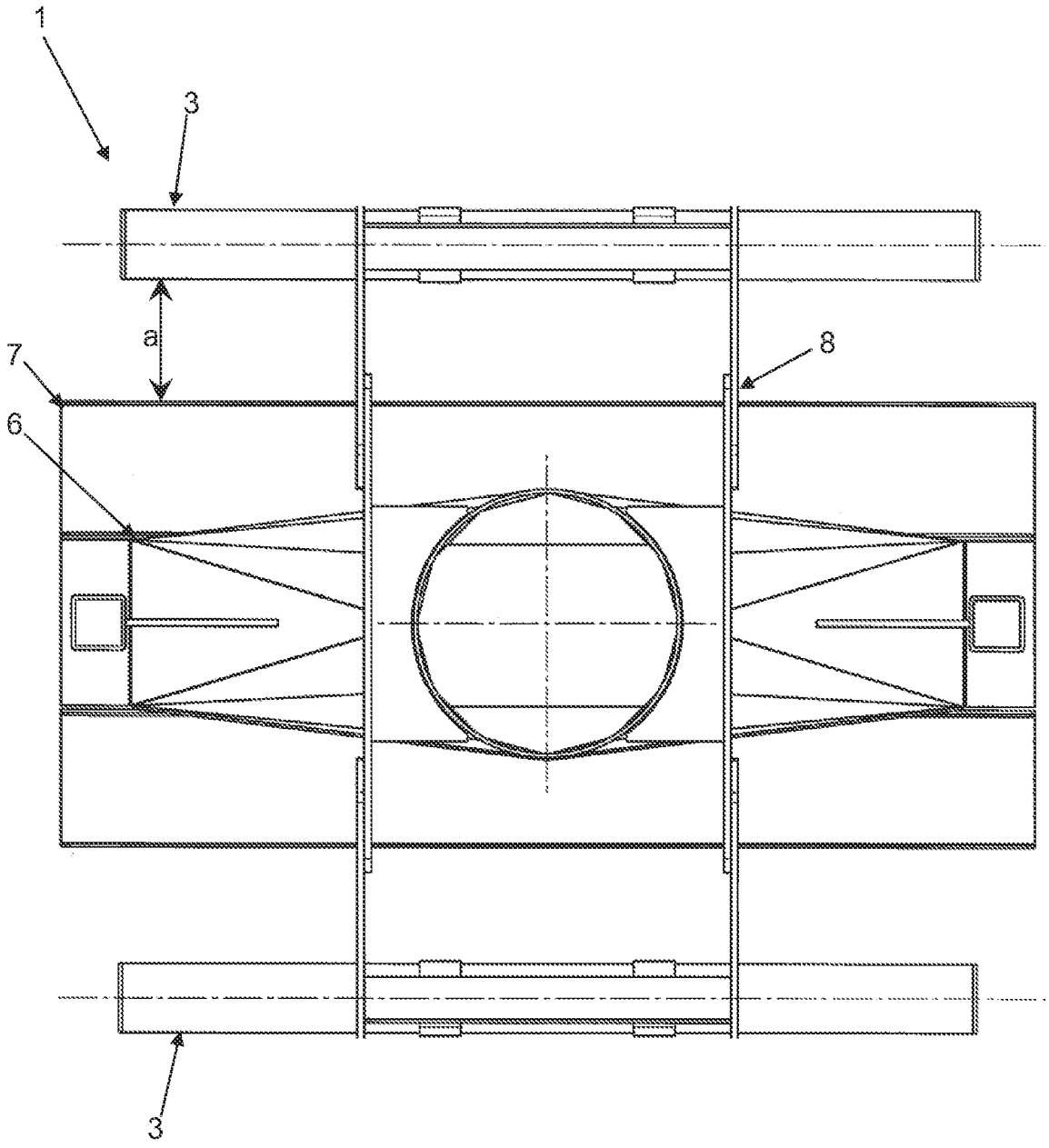
FIG. 5 is a plan view of the device shown in FIGS. 3 and 4.

As shown in FIG. 3 to 5, the device 1 comprises a plurality of air nozzles 4 for a compressed air supply. The air nozzles 4 are arranged at a common intake 3, and on either side of an aspiration opening 5, designed as a suction mouth, of an aspiration hood 6, and are inclined relative to the surface 2. The aspiration opening 5 is surrounded by two air guide elements 7 which adjoin the aspiration opening 5 in the horizontal direction in a parallel manner and without gaps and which are each formed by a component which is releasably connected to the aspiration hood 6.

The intakes 3 for the air nozzles 4 are arranged in such a manner on a support arm 8 which can be pivoted and displaced longitudinally into different latching positions that the intakes 3 can be positioned with a variable spacing a from an outer edge of the air guide element 7 and that the air nozzles 4 are inclined towards the aspiration opening 5. As a result, the air nozzles 4 can in particular be positioned with a spacing b, which is reduced in relation to the aspiration opening 5, from the surface 2.

The arrangement of the air guide elements 7 parallel to the surface 2 in conjunction with the horizontal flow deflection of the supplied air has the result that the compressed air of the air nozzles 4, after impinging on the surface 2 to be cleaned, is initially deflected between the air guide element 7 and the surface 2 in the arrow direction 9 parallel to the surface 2 and, after further deflection, enters the aspiration opening 5. As a result, in operation a virtually laminar flow between the air guide element 7 and the surface 2 occurs, which produces substantially better cleaning power in comparison with a turbulent air flow which is deflected in an undefined manner at the surface to be cleaned in the prior art.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

What is claimed is:

1. A device for cleaning wall surfaces, ground surfaces, track superstructures or tunnel walls and configured to be arranged on a rail vehicle that moves along a direction of travel, the device comprising:

an aspirator opening; and at least two air nozzles arranged in rows of air nozzles disposed on either side of the aspirator opening such that the aspirator opening is disposed between the rows of air nozzles, the rows of air nozzles being supplied with compressed air such that the pressure of the row of air nozzles disposed in front of the aspiration opening in the direction of travel of the rail vehicle is lower than the pressure of the other row of air nozzles.

2. The device recited in claim 1, further comprising a control unit configured to detect the direction of travel of the rail vehicle, and wherein the air nozzles of each row of air nozzles are configured to be subjected to a high or low pressure depending on the direction of travel of the rail vehicle.

3. The device recited in claim 1, wherein the air nozzles have an orientation which is inclined relative to a ground surface in such a way that the nozzles form an acute angle with a surface normal to the wall or ground surface, and wherein the air nozzles are inclined such that at least the rear row of nozzles is directed to a region of the wall or ground surface below the aspiration opening.

4. The device recited in claim 1, wherein the air nozzles of a first of the row of nozzles are pivotable to adjust orientation.

5. The device recited in claim 1, further comprising an aspiration hood which adjoins the aspiration opening, wherein at least one of the aspiration hood or the rows of nozzles are arranged such that they can be moved to adjust a variable width of the wall or ground surface covered by the aspiration hood or the rows of nozzles.

6. The device recited in claim 5, wherein the at least one of the aspiration hood or the rows of nozzles is movable by a drive.

7. The device recited in claim 1, wherein the rows of nozzles are oriented transverse to the direction of travel.

8. The device recited in claim 1, wherein the air nozzles have at least one of an adjustable inclination angle or spacing with respect to at least one of the aspiration opening or the wall or ground surface.

9. The device recited in claim 1, wherein the device comprises a control system and sensors, in order to detect in a timely manner at least one of the spacing of the air nozzles from the wall or ground surface or obstacles which limit the free space.

10. The device recited in claim 1, further comprising distance measurement sensors.

11. The device recited in claim 10, wherein the distance measurement sensors include at least one of laser, ultrasonic, sonar or lidar sensors.

12. The device recited in claim 1, wherein at least one of an aspiration power of the device or a power of the compressed-air supply to the air nozzles is adjustable in a variable manner.

13. A rail vehicle comprising:

a device for cleaning wall surfaces, ground surfaces, track superstructures or tunnel walls and configured to be arranged on a rail vehicle that moves along a direction of travel, the device including:

an aspirator opening; and at least two air nozzles arranged in rows of air nozzles disposed on either side of the aspirator opening such that the aspirator opening is disposed between the rows of air nozzles, the rows of air nozzles being supplied with compressed air such that the pressure of the row of air nozzles disposed in front of the aspiration opening in the direction of travel of the rail vehicle is lower than the pressure of the other row of air nozzles.

* * * * *